US010788292B2

(12) United States Patent
Alldredge et al.

(10) Patent No.: US 10,788,292 B2
(45) Date of Patent: Sep. 29, 2020

(54) QUICK-DETACH OPTICS AND ACCESSORY MOUNTING SYSTEM FOR FIREARMS

(71) Applicant: B.E. Meyers & Co., Inc., Redmond, WA (US)

(72) Inventors: Thomas Alldredge, Redmond, WA (US); Alexander Bigby, Redmond, WA (US)

(73) Assignee: B.E. MEYERS & CO., INC., Redmond, WA (US)

( * ) Notice: Subject to any disclaimer, the term of this patent is extended or adjusted under 35 U.S.C. 154(b) by 0 days.

(21) Appl. No.: 15/938,985

(22) Filed: Mar. 28, 2018

(65) Prior Publication Data

US 2018/0283826 A1 Oct. 4, 2018

Related U.S. Application Data

(60) Provisional application No. 62/478,503, filed on Mar. 29, 2017.

(51) Int. Cl.
*F41G 11/00* (2006.01)
*F41A 3/66* (2006.01)

(52) U.S. Cl.
CPC ..... *F41G 11/003* (2013.01); *F41A 3/66* (2013.01); *F41G 11/004* (2013.01)

(58) Field of Classification Search
CPC ..... F41G 11/00; F41G 11/001; F41G 11/003; F41G 11/004; F41G 1/387
See application file for complete search history.

(56) References Cited

U.S. PATENT DOCUMENTS 958,989 A * 5/1910 Bennett ..... F41G 11/003 42/124
1,428,655 A * 9/1922 Noske ..... F41G 11/003 42/125

(Continued)

FOREIGN PATENT DOCUMENTS

| | | |
|---|---|---|
| EP | 1983291 | 10/2008 |
| FR | 2991040 | 11/2013 |
| GB | 2487834 | 8/2012 |

OTHER PUBLICATIONS

Author unknown; European Search Report of European Patent Application No. 18165161.3; dated Aug. 28, 2018; 11 pgs.

(Continued)

*Primary Examiner* — Derrick R Morgan
(74) *Attorney, Agent, or Firm* — K&L Gates LLP

(57) ABSTRACT

An accessory mounting system offering quick disconnect and true return-to-zero reattach is described. The mounting system includes a base, which is attached to the host platform, and a top mount onto which one or more accessories can be mounted. The base may be installed with a friction clamp and can remain attached to the host platform while the top mount can be removed and returned while keeping all optics and lasers mounted. The coupling of the base and top mount can provide sufficient precision such that the mounting system can retain zero upon reattach. The top mount may include one or more rail segments, which can enable the mounting of a laser system in conjunction with a top mounted optic, even when the firearm is used in conjunction with a gun shield.

17 Claims, 18 Drawing Sheets

(56) References Cited

U.S. PATENT DOCUMENTS 2,018,961 A * 10/1935 Kuhn ..... F41G 11/001 24/19
2,135,774 A * 11/1938 Tilden ..... F41G 11/003 42/126
2,645,855 A * 7/1953 Ivy ..... F41G 11/001 42/126
3,235,967 A * 2/1966 Moure ..... F41G 11/003 42/122
3,463,430 A * 8/1969 Jimenez ..... F41G 11/003 248/229.15
3,555,687 A * 1/1971 Joseph ..... F41G 11/001 42/124
3,671,000 A * 6/1972 Williams ..... F41G 1/06 248/205.1
3,835,565 A * 9/1974 Weast ..... F41G 11/003 42/124
3,875,675 A * 4/1975 Krisay ..... F41G 11/003 42/124
4,021,954 A * 5/1977 Crawford ..... F41G 11/003 42/127
4,026,055 A * 5/1977 Weast ..... F41G 11/003 42/124
4,299,044 A * 11/1981 Johannsen ..... F41G 11/003 42/127
4,367,606 A * 1/1983 Bechtel ..... F41G 11/003 42/127
4,429,468 A * 2/1984 Jimenez ..... F41G 11/003 42/111
4,501,071 A * 2/1985 Manske ..... F41G 11/001 42/127
4,509,282 A * 4/1985 McMillon ..... F41G 11/003 42/124
4,688,345 A * 8/1987 Kilgour ..... F41G 11/003 42/127
4,707,772 A * 11/1987 Jimenez ..... F41G 1/35 362/110
4,841,659 A * 6/1989 Williams ..... F41G 1/38 42/119
4,890,407 A * 1/1990 Nichols ..... F41G 1/16 42/112
4,941,277 A * 7/1990 Lawlor ..... F41G 11/003 42/111
D318,313 S * 7/1991 Bechtel ..... D22/110
5,033,219 A * 7/1991 Johnson ..... F41G 1/35 362/289
D322,834 S * 12/1991 Lawlor ..... D22/110
5,086,566 A * 2/1992 Klumpp ..... F41G 11/003 42/126
D336,675 S * 6/1993 Rubin ..... D22/110
5,274,941 A * 1/1994 Moore ..... F41G 11/005 42/126
5,337,506 A * 8/1994 Klotz ..... F41G 11/002 42/124
5,428,915 A * 7/1995 King ..... F41G 11/003 42/126
5,595,011 A * 1/1997 Gorslin ..... F41G 11/001 42/112
5,669,173 A * 9/1997 Rodney, Jr. ..... F41G 11/002 42/124
5,694,712 A * 12/1997 Plonka ..... F41G 11/003 42/124
5,787,630 A * 8/1998 Martel ..... F41G 11/003 42/125
5,887,375 A * 3/1999 Watson ..... F41G 11/001 42/106
6,216,351 B1 * 4/2001 Flubacher ..... F41G 1/34 42/145
6,295,754 B1 * 10/2001 Otteman ..... F41G 1/38 42/111
6,336,285 B1 * 1/2002 Baumer ..... F41G 1/00 42/113
6,338,219 B1 * 1/2002 Watson, Jr. ..... F41G 1/01 42/130
6,418,657 B1 * 7/2002 Brown ..... F41G 1/26 42/124
6,701,660 B2 * 3/2004 Stover ..... F41G 11/003 42/124
6,722,074 B1 * 4/2004 Farrell ..... F41G 11/003 42/124
6,886,288 B1 * 5/2005 Yocum ..... F41G 11/003 42/124
6,922,934 B1 * 8/2005 Huan ..... F41G 11/003 42/127
7,506,643 B2 * 3/2009 Holmberg ..... F41B 5/12 124/25
7,520,083 B2 * 4/2009 Dextraze ..... F41G 1/393 42/124
7,594,352 B2 * 9/2009 Holmberg ..... F16M 13/00 248/309.1
7,739,822 B1 * 6/2010 Holmberg ..... F41A 35/00 124/86
D632,753 S * 2/2011 Leighton ..... D22/109
D637,260 S * 5/2011 Swan ..... D22/109
8,186,093 B1 * 5/2012 Chung ..... F41G 1/35 42/113
8,240,075 B1 * 8/2012 Mullin ..... F41G 11/003 42/119
D668,730 S * 10/2012 Casas Salva ..... F41G 11/003 D22/108
8,453,369 B1 * 6/2013 Kincaid ..... F41C 33/0254 403/322.1
8,484,879 B2 * 7/2013 Riley ..... F41G 11/004 362/110
8,522,469 B2 * 9/2013 Baker ..... F41G 11/003 42/124
8,726,562 B1 * 5/2014 Hoskisson ..... F41G 11/003 42/124
D738,986 S * 9/2015 Anderson ..... D22/109
9,470,480 B2 * 10/2016 Kirchhoff ..... F41G 11/001
9,671,198 B2 * 6/2017 Bartoszewicz ..... F41G 11/003
9,677,854 B1 * 6/2017 Tran ..... F41G 11/003
10,001,344 B1 * 6/2018 Alford ..... F41C 27/00
D822,143 S * 7/2018 Alldredge ..... D22/109
10,024,632 B1 * 7/2018 Oglesby ..... F41C 27/00
D828,481 S * 9/2018 Alldredge ..... D22/110
D828,482 S * 9/2018 Alldredge ..... D22/110
10,119,787 B2 * 11/2018 Geissele ..... F41G 11/003
2005/0252060 A1 * 11/2005 Gonzalez ..... F41C 23/16 42/90
2007/0169393 A1 7/2007 Frost
2007/0266611 A1 * 11/2007 Stover ..... F41G 11/003 42/124
2008/0072471 A1 * 3/2008 Keng ..... F41G 11/003 42/124
2010/0058640 A1 * 3/2010 Moore ..... F41G 1/35 42/114
2010/0107467 A1 * 5/2010 Samson ..... F41G 11/003 42/127
2010/0275497 A1 * 11/2010 Brentzel ..... F41G 11/003 42/125
2010/0282066 A1 * 11/2010 Tankersley ..... F41A 5/26 89/193
2011/0076095 A1 * 3/2011 Storch ..... F41C 27/00 403/322.4
2011/0154713 A1 * 6/2011 Jung ..... F41G 1/30 42/137
2012/0055062 A1 * 3/2012 Mironichev ..... F41C 23/02 42/85
2012/0085014 A1 * 4/2012 Riley ..... F41G 11/004 42/115
2012/0168589 A1 * 7/2012 Riley ..... F41G 11/003 248/315
2012/0174462 A1 * 7/2012 Spuhr ..... F41G 1/387 42/124
2012/0180369 A1 * 7/2012 Koesler ..... F41G 1/027 42/132

(56) References Cited

U.S. PATENT DOCUMENTS

2012/0311909 A1* 12/2012 Cheng ..... F41C 27/00 42/90
2012/0311910 A1* 12/2012 Mironichev ..... F41C 23/10 42/90
2013/0008073 A1* 1/2013 Clifton ..... F41G 11/003 42/125
2013/0118051 A1* 5/2013 Baker ..... F41G 11/003 42/90
2013/0180156 A1* 7/2013 Shebaro ..... F41G 1/01 42/144
2014/0059908 A1* 3/2014 Dextraze ..... F41G 11/002 42/1.06
2014/0096429 A1* 4/2014 Sandler ..... F41G 11/003 42/124
2014/0157644 A1* 6/2014 Jiminez ..... F41G 11/003 42/114
2015/0020429 A1* 1/2015 Savoy ..... F41G 11/003 42/111
2015/0040456 A1* 2/2015 Zimmer ..... F41G 11/003 42/90
2015/0198414 A1* 7/2015 Raybman ..... F41G 1/17 42/111
2015/0345901 A1* 12/2015 Cheng ..... F41C 33/08 42/111
2016/0258714 A1* 9/2016 Drummond ..... F41G 11/003
2016/0349006 A1* 12/2016 Neville ..... F41C 27/18
2016/0377383 A1* 12/2016 Downing ..... F41G 11/003 42/111
2017/0023320 A1* 1/2017 Barrett ..... F41A 3/66
2017/0023333 A1* 1/2017 Faifer ..... F41G 11/003
2017/0059280 A1* 3/2017 Fravor ..... F41G 11/003
2017/0234646 A1* 8/2017 Flagler ..... F41G 11/003 42/71.01
2017/0299337 A1* 10/2017 Ding ..... F41G 11/004
2017/0356722 A1* 12/2017 Jeung ..... F41G 1/28
2017/0363387 A1* 12/2017 Sun ..... F41G 1/35
2018/0058813 A1* 3/2018 Minor ..... F41G 11/003
2018/0073840 A1* 3/2018 Kristoffersen ..... F41G 11/003
2018/0142991 A1* 5/2018 Rogers ..... F41G 11/003
2018/0195838 A1* 7/2018 Storch ..... F41A 3/66
2018/0306554 A1* 10/2018 Patton ..... F41G 11/003
2018/0364008 A1* 12/2018 Summerfield ..... F41G 11/003
2019/0011225 A1* 1/2019 Sun ..... F41G 1/54
2019/0033039 A1* 1/2019 Masarik ..... F41G 11/003

OTHER PUBLICATIONS

Computer-Generated Translation of FR2991040 retrieved from Google Patents Oct. 12, 2018; 5 pgs.

* cited by examiner

QUICK-DETACH OPTICS AND ACCESSORY MOUNTING SYSTEM FOR FIREARMS

CROSS-REFERENCE TO RELATED APPLICATION

This application claims the benefit of U.S. provisional application No. 62/478,503, filed Mar. 29, 2017, the disclosure of which is incorporated herein by reference in its entirety.

FIELD

The present disclosure relates to firearms, and, more particularly, to firearm accessory systems.

BACKGROUND

Standard mounting platforms have been used for attaching optics and other accessories to firearms. One such platform is the Picatinny rail, which includes a rail having multiple transverse slots. An accessory having a corresponding rail mount can be mounted to the firearm by sliding the accessory down the Picatinny rail and securely clamping the accessory to the rail, typically using clamps or screws. After optics accessories, such as telescopic sights or laser optics, are mounted to a firearm, the firearm is then zeroed by adjusting the optics so as to ensure that the point of aim of the optics is the point of impact. However, each time an accessory is detached from the firearm and later re-mounted, the firearm must be zeroed again. It would be desirable to provide a more effective accessory mounting system for firearms.

SUMMARY

In accordance with embodiments of the present invention, an accessory mounting system offering quick disconnect is provided. This mounting system can provide a true return-to-zero reattach. The mounting system includes a base, which is attached to the host platform, and a top mount onto which one or more accessories can be mounted. The base may be installed with a friction clamp and can remain attached to the host platform while the top mount can be removed and returned while keeping all optics and lasers mounted. The coupling of the base and top mount can provide sufficient precision such that the mounting system can retain zero upon reattach. The top mount may include one or more rail segments, which can enable the mounting of a laser system in conjunction with a top mounted optic, even when the firearm is used in conjunction with a gun shield.

In accordance with some embodiments, the mounting system can provide a low profile for an optics mount, which can enable the user to keep the user's head as low behind the gun shield as possible while still having a pass-through to utilize the standard iron sights. The system may be snag and sharp edge free so as not to interfere with the operating of the host weapon. The base of the mount may include a host connector portion which can enable the base to be left in place on the host system or can be easily removed as needed. The host connector portion may enable the base to be re-indexed to the same location upon re-mounting, and can be non-marring on the host system.

Systems and methods are provided for a firearm accessory mounting system. In a first embodiment, a firearm accessory mounting system comprises: a base assembly comprising: a host connector on a bottom side of the base assembly operable to couple with a firearm; and a mount connector on a top side of the base assembly; and a top mount comprising: a base connector on a bottom side of the top mount, the base connector being detachably coupled to the mount connector of the base assembly; and a rail connector on a top side of the top mount.

Still other embodiments of the present invention will become readily apparent to those skilled in the art from the following detailed description, which describes embodiments illustrating various examples of the invention. As will be realized, the invention is capable of other and different embodiments and its several details are capable of modifications in various respects, all without departing from the spirit and the scope of the present invention.

DETAILED DESCRIPTION

In the following description, reference is made to the accompanying drawings that illustrate several embodiments of the present disclosure. It is to be understood that other embodiments may be utilized and system or process changes may be made without departing from the spirit and scope of the present disclosure. The following detailed description is not to be taken in a limiting sense, and the scope of the embodiments of the present invention is defined only by the claims of the issued patent. It is to be understood that drawings are not necessarily drawn to scale.

Various embodiments of the present disclosure provide improved firearm accessory mounting systems. These embodiments may enable accessories to be quickly mounted and detached, while maintaining precise calibration of the accessory. In contrast with conventional rail systems which are designed to enable the user to quickly detach an accessory from the rail, embodiments of the present invention are designed to enable the user to quickly detach the rail from the firearm, with the accessory still attached to the rail. Then, the rail with the attached accessory can then be quickly re-mounted onto the firearm.

Figure 1:
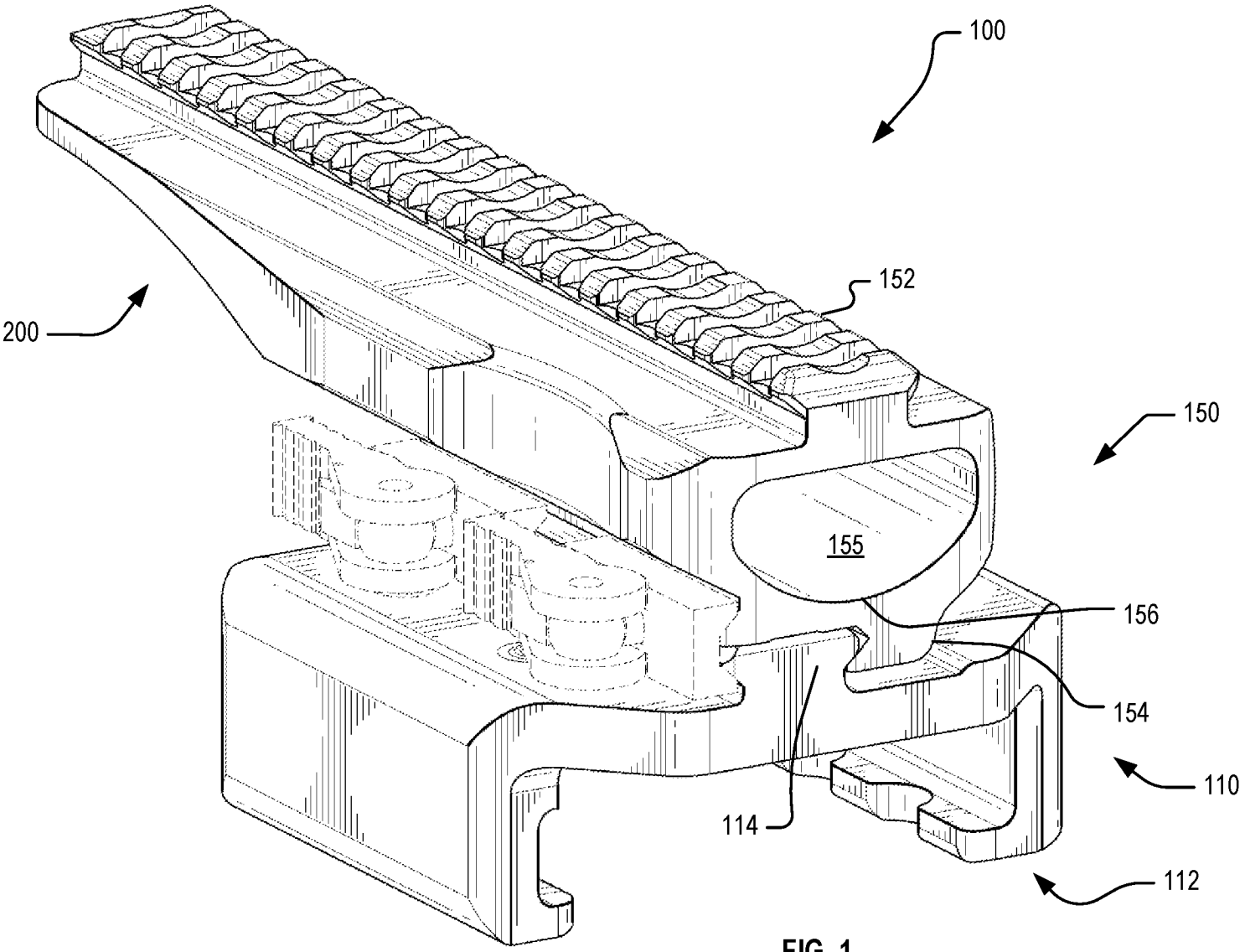
FIG. 1 is a front perspective view of an accessory mounting system, in accordance with embodiments of the present invention.
Figure 2A:
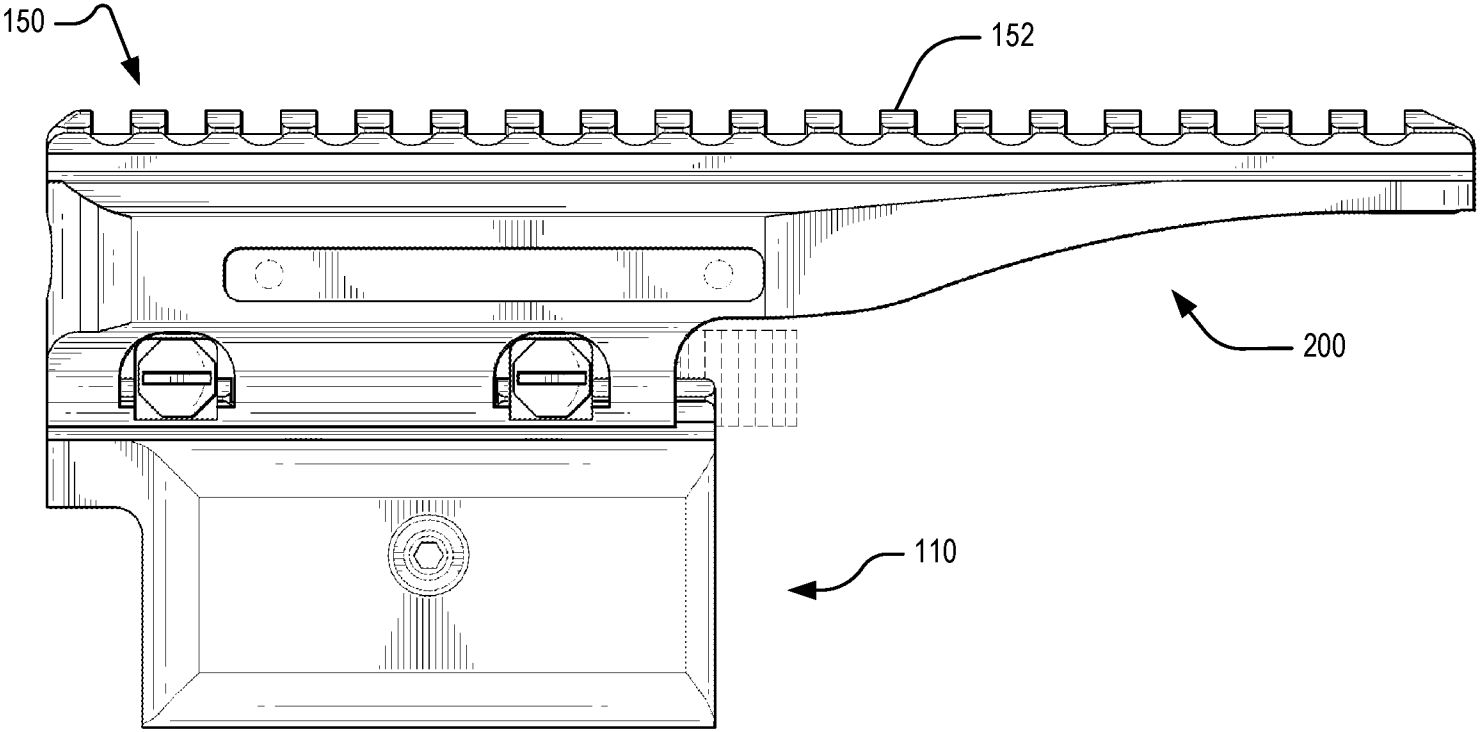
FIGS. 2A-2B are left and right side plan views, respectively, of the accessory mounting system, in accordance with embodiments of the present invention.
Figure 2B:
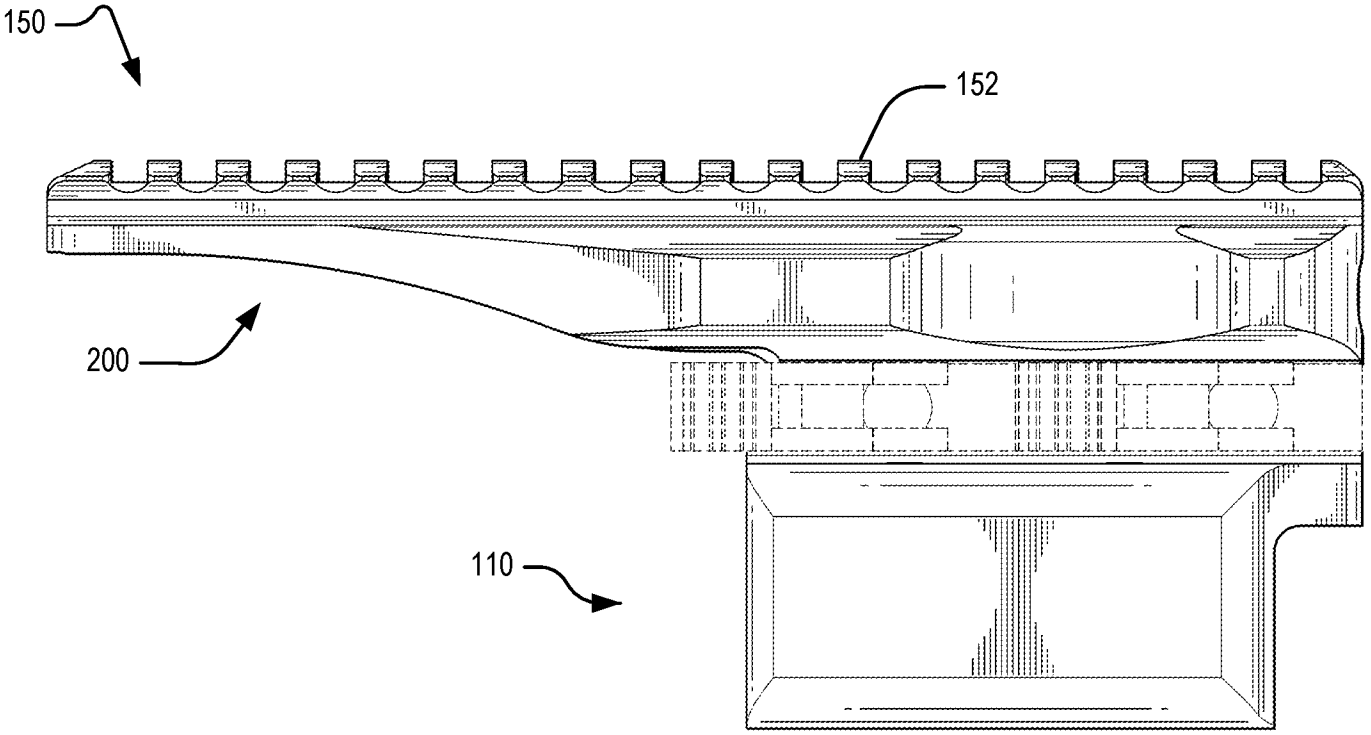
Figure 3A:
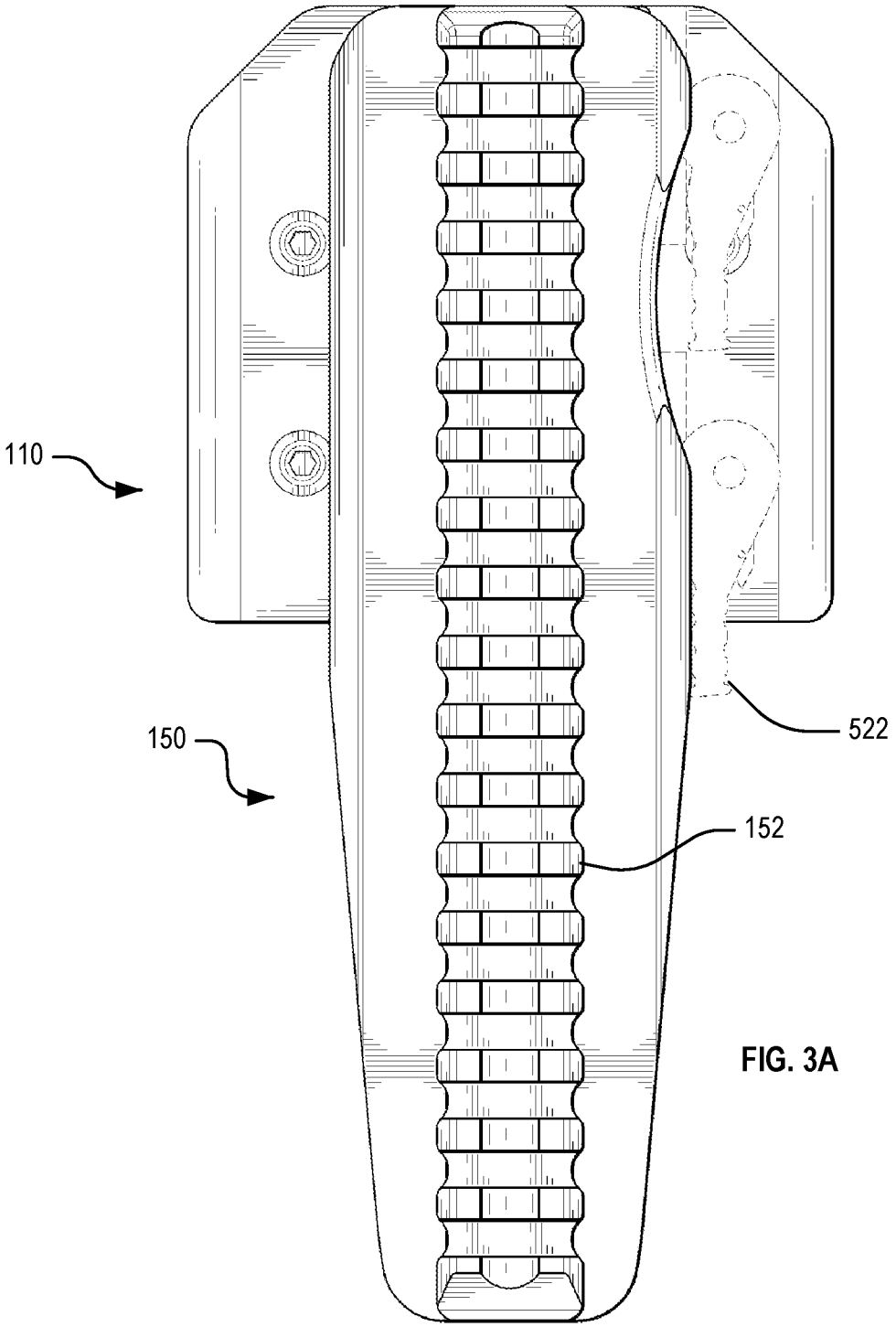
FIGS. 3A-3B are top and bottom plan views, respectively, of the accessory mounting system, in accordance with embodiments of the present invention.
Figure 3B:
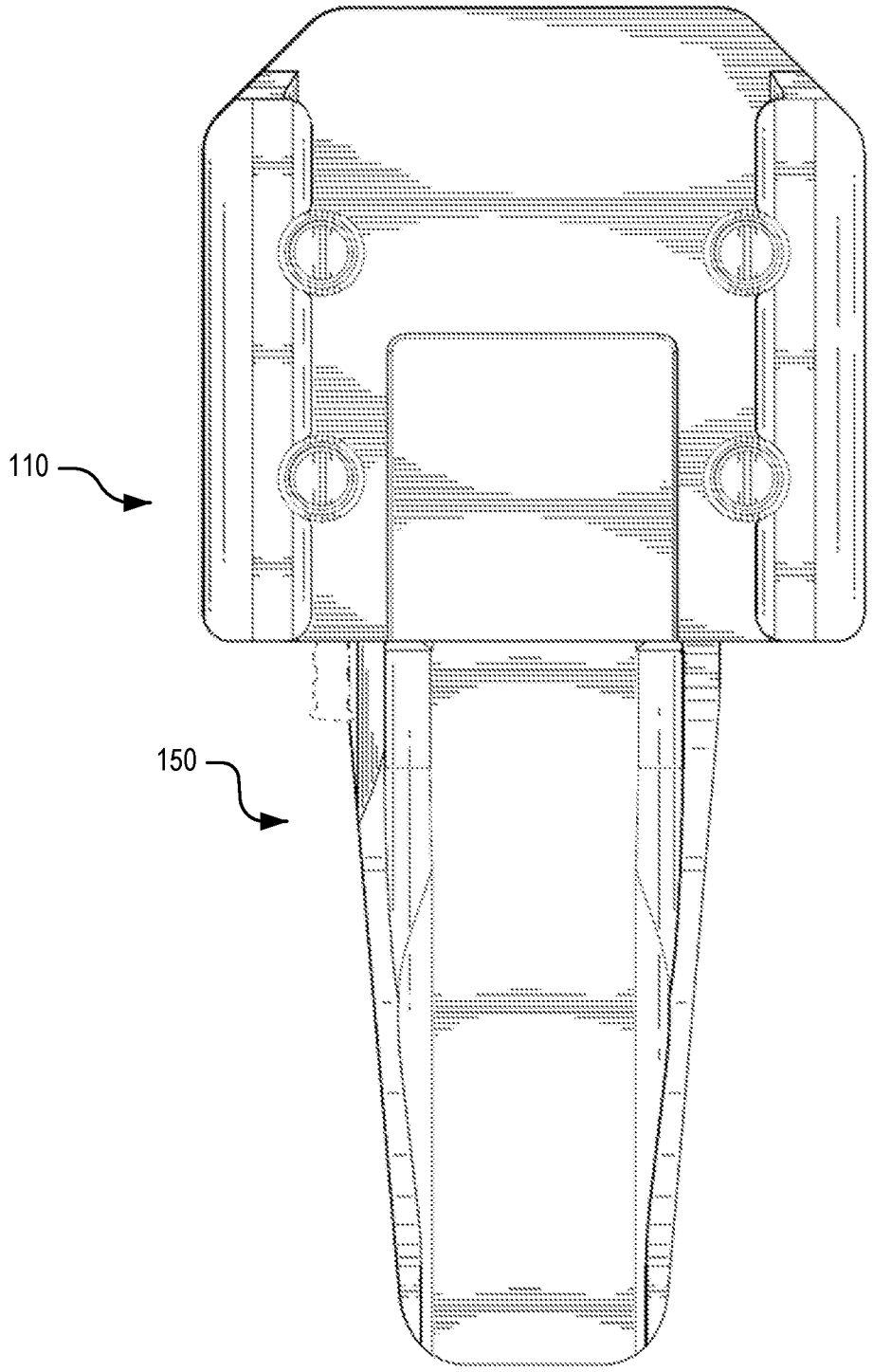
Figure 4A:
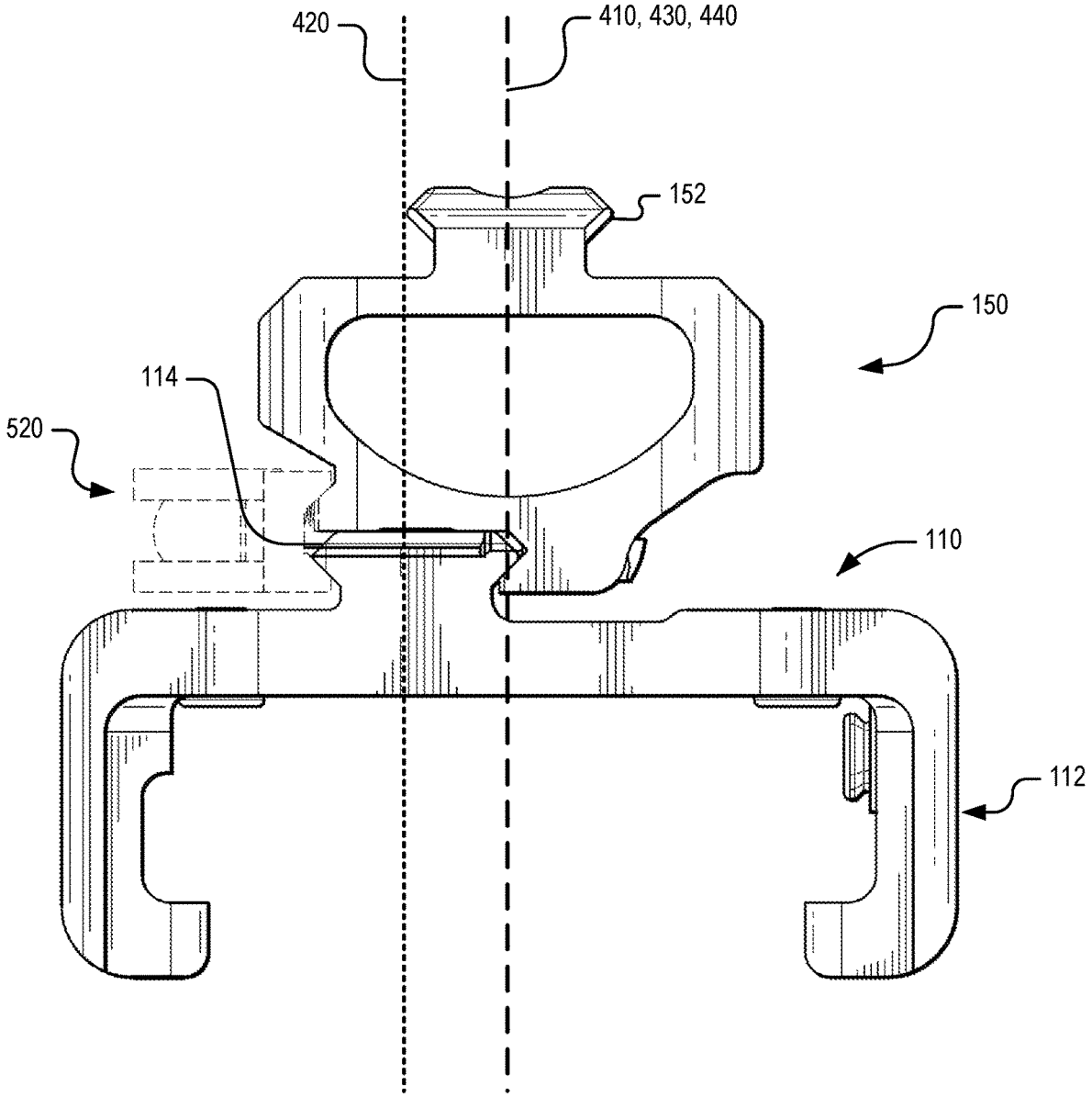
FIGS. 4A-4B are front and rear plan views, respectively, of the accessory mounting system, in accordance with embodiments of the present invention.
Figure 4B:
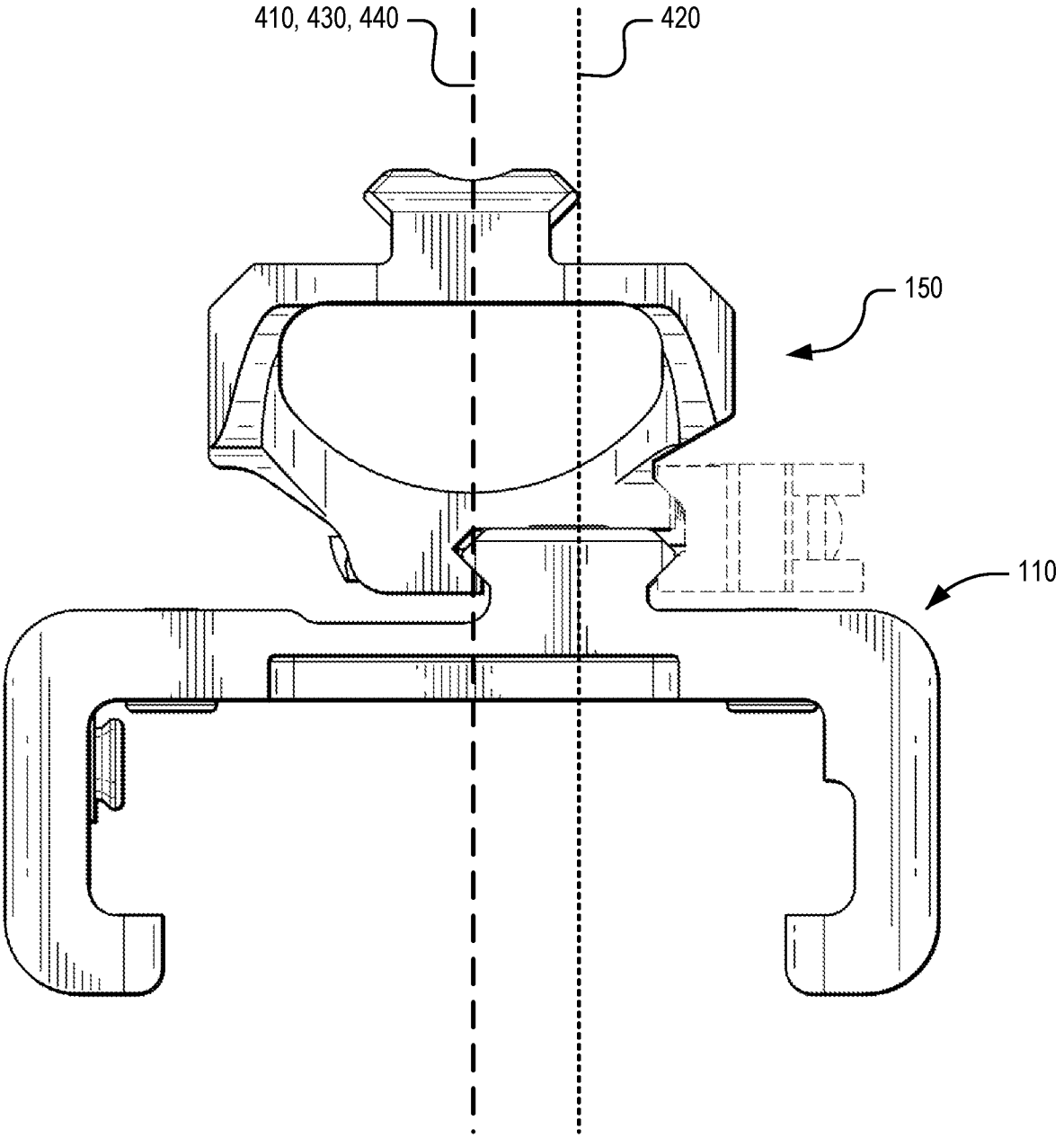

FIG. 1 is a front perspective view of an accessory mounting system 100, in accordance with embodiments of the present invention. FIGS. 2A-2B are left and right side plan views, respectively, of the system 100; FIGS. 3A-3B are top and bottom plan views, respectively, of the system 100; and FIGS. 4A-4B are front and rear plan views, respectively, of the system 100.

The illustrated example system 100 is configured for use with a belt-fed, crew-serviced M2 machine gun, but other embodiments may be configured for use with other types of firearms. The system 100 includes a top mount 150 releasably attached to a base assembly 110.

Figure 5A:
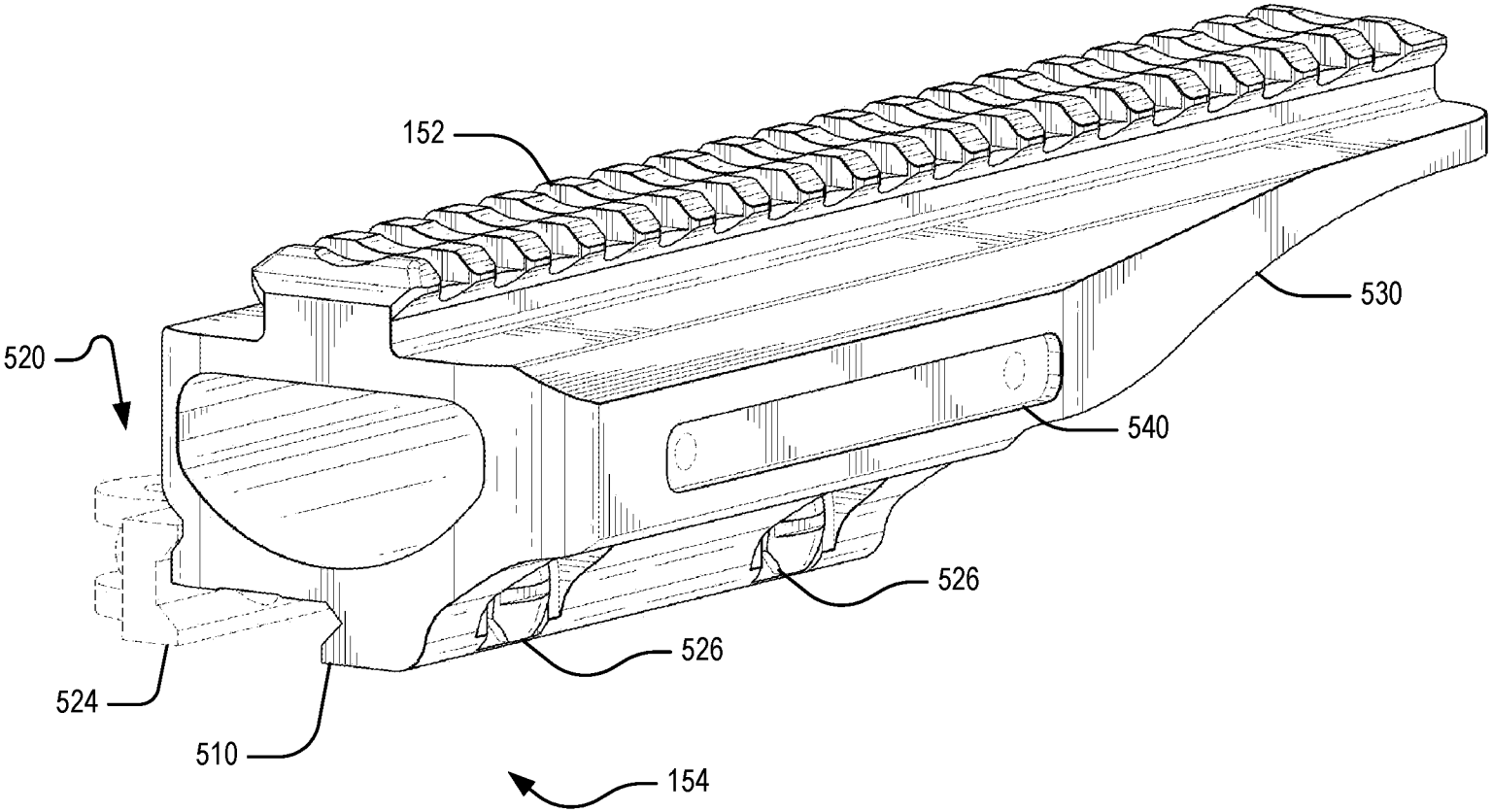
FIGS. 5A-5B are front and rear perspective views of a top mount of the accessory mounting system, in accordance with embodiments of the present invention.
Figure 5B:
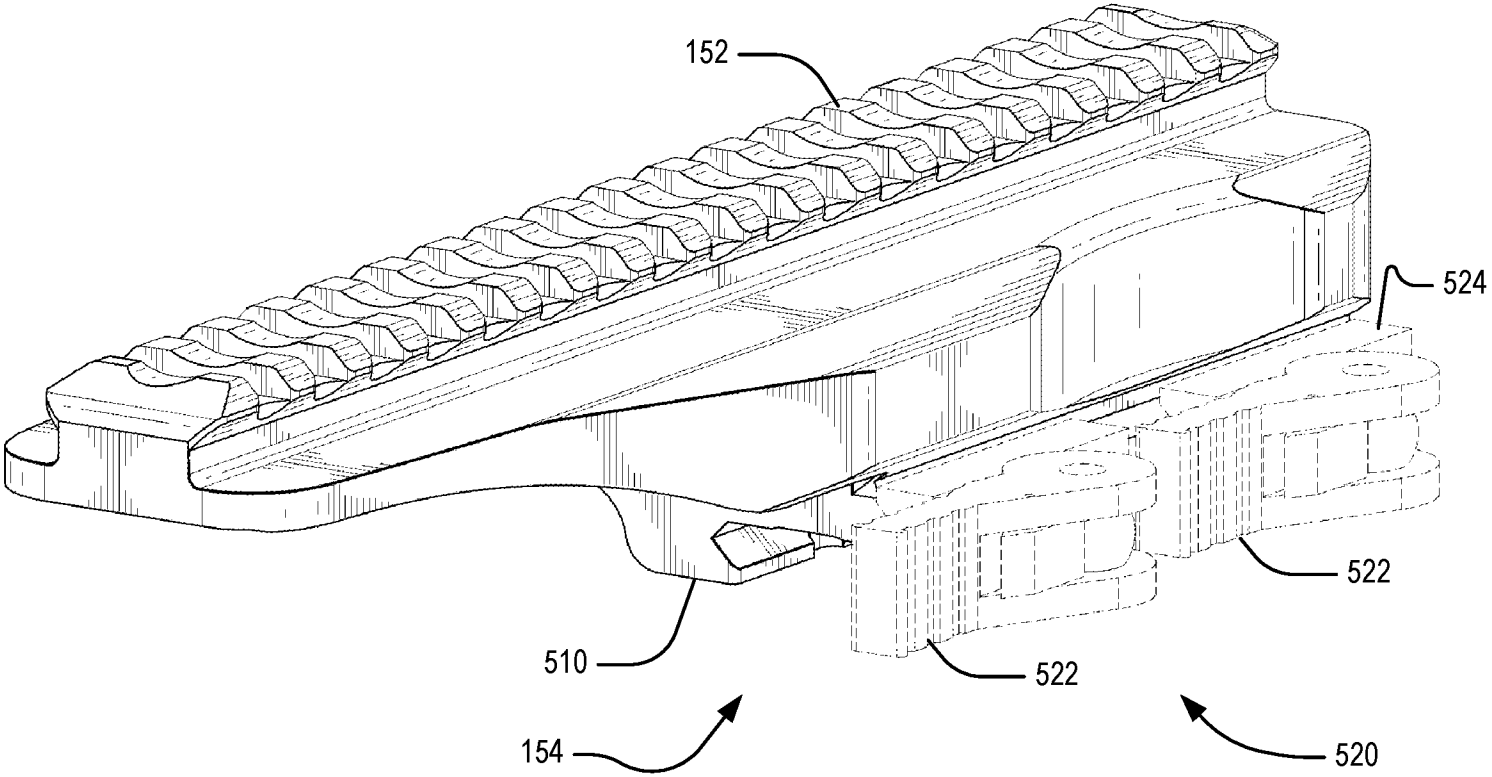
Figure 6A:
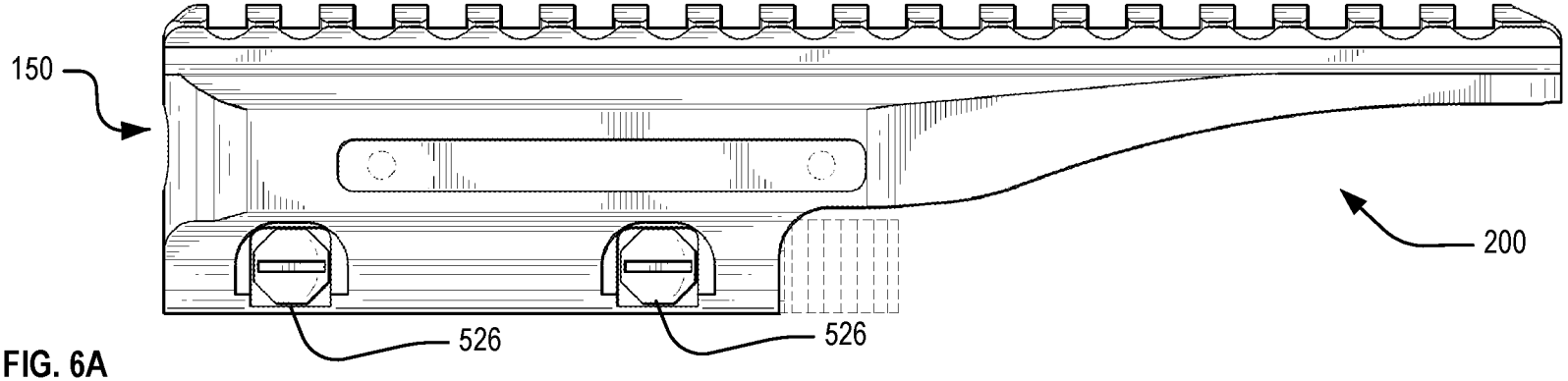
FIGS. 6A-6B are left and right side plan views, respectively, of the top mount of the accessory mounting system, in accordance with embodiments of the present invention.
Figure 6B:
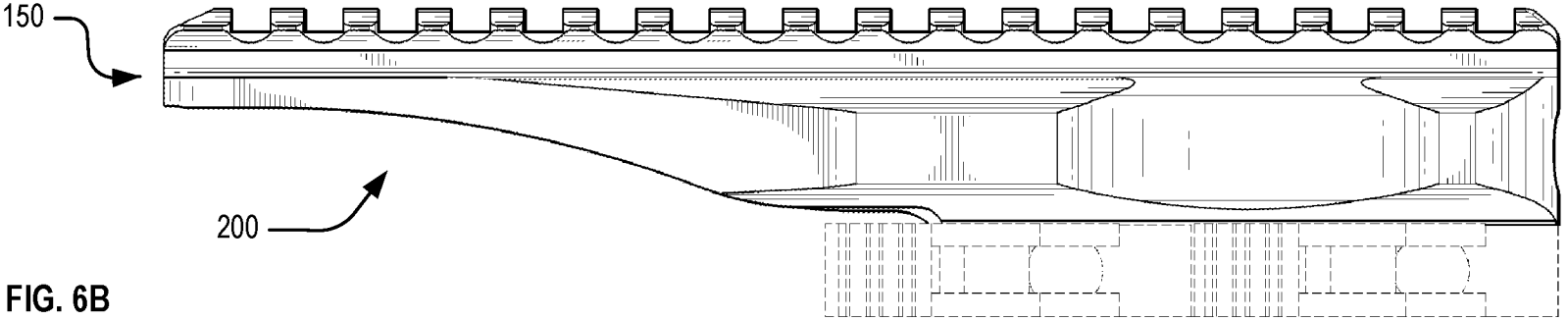
Figure 7A:
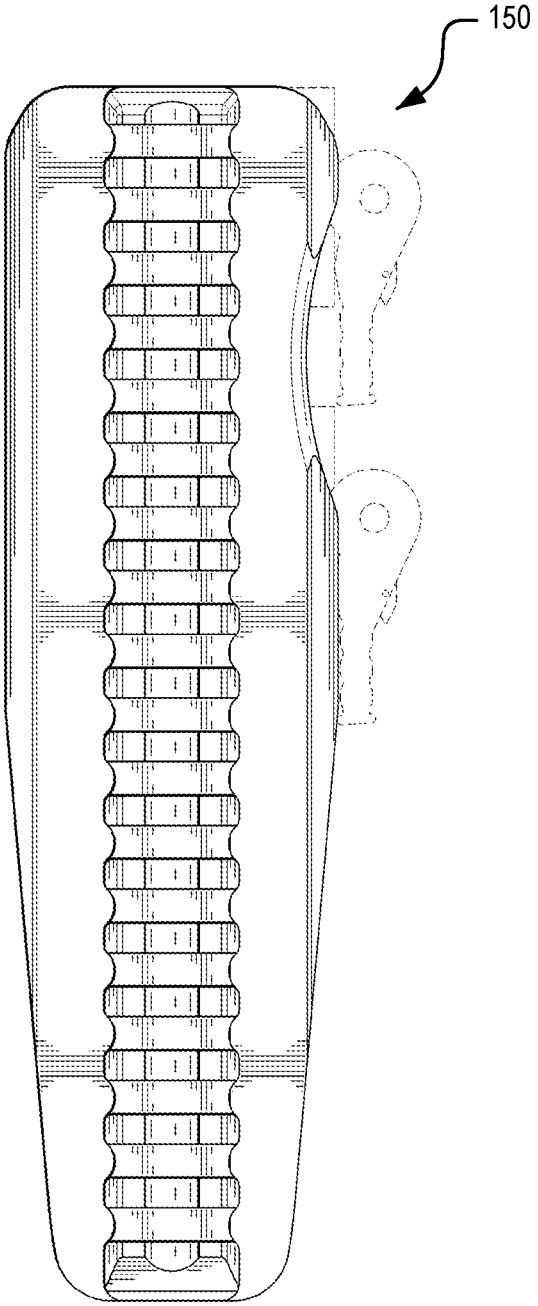
FIGS. 7A-7B are top and bottom plan views, respectively, of the top mount of the accessory mounting system, in accordance with embodiments of the present invention.
Figure 7B:
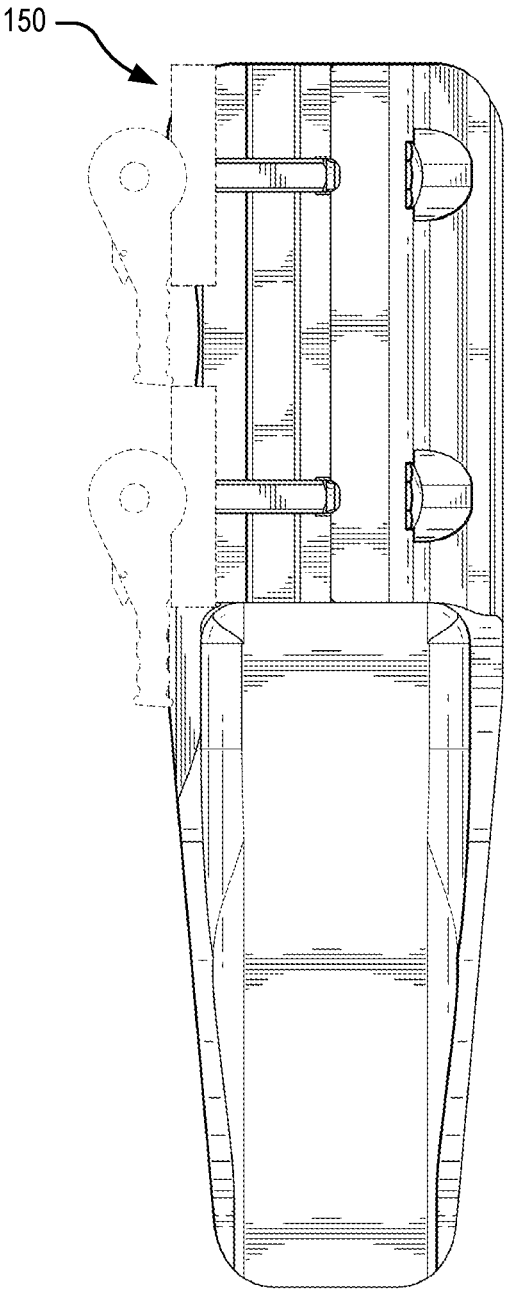
Figure 8A:
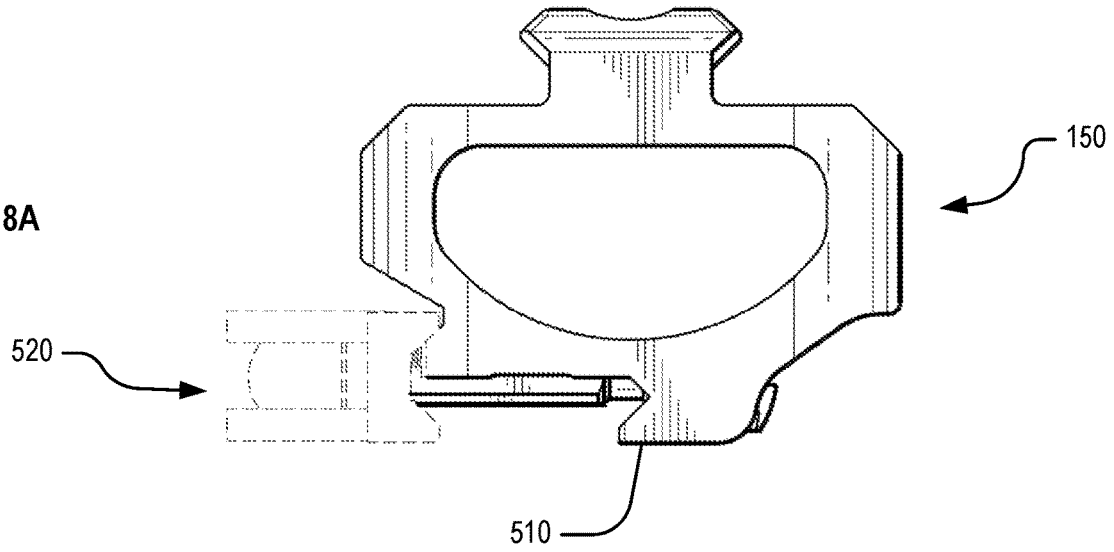
FIGS. 8A-8B are front and rear plan views, respectively, of the top mount of the accessory mounting system, in accordance with embodiments of the present invention.
Figure 8B:
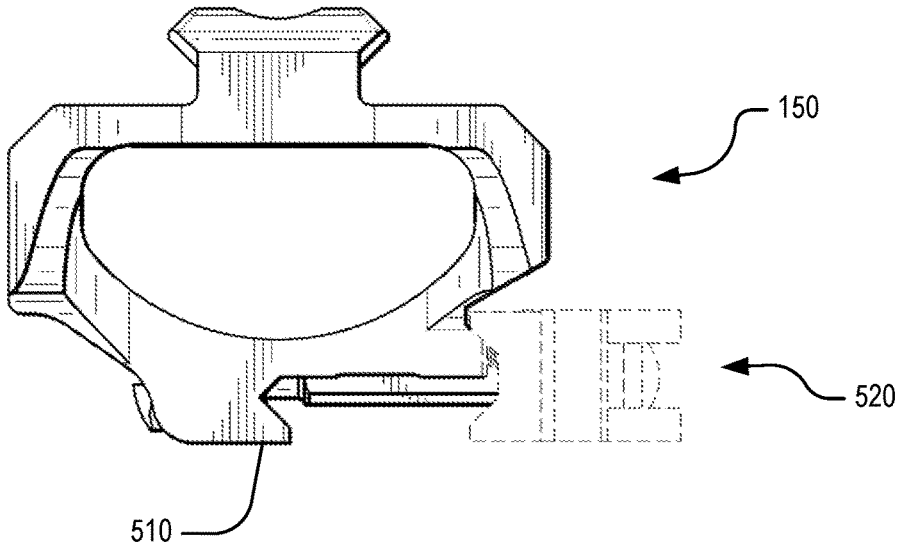

FIGS. 5A-5B are front and rear perspective views of the top mount 150 of the accessory mounting system 100, in accordance with embodiments of the present invention. FIGS. 6A-6B are left and right side plan views, respectively, of the top mount 150; FIGS. 7A-7B are top and bottom plan views, respectively, of the top mount 150; and FIGS. 8A-8B are front and rear plan views, respectively, of the top mount 150.

Figure 9A:
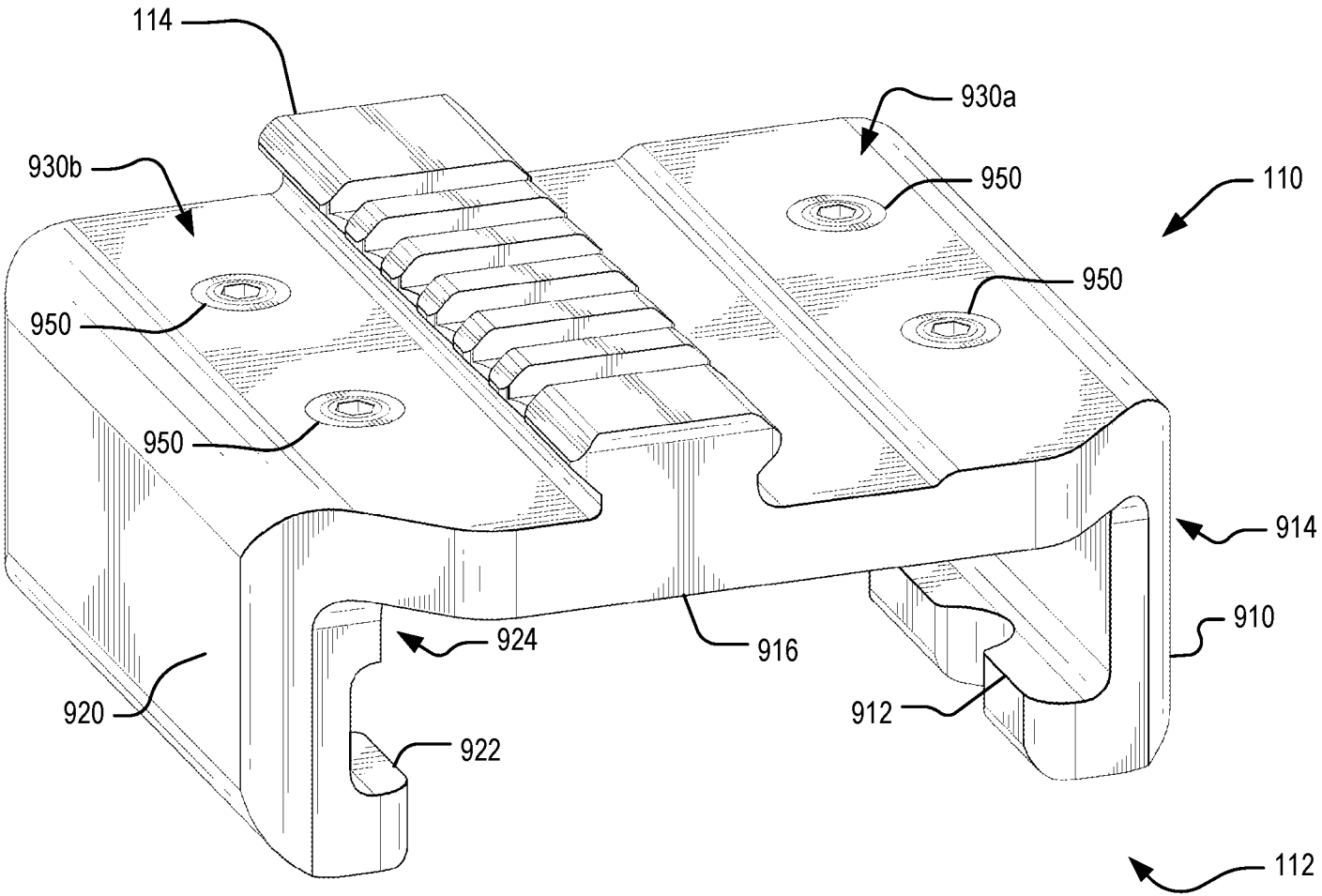
FIGS. 9A-9B are front and rear perspective views of a base of the accessory mounting system, in accordance with embodiments of the present invention.
Figure 9B:
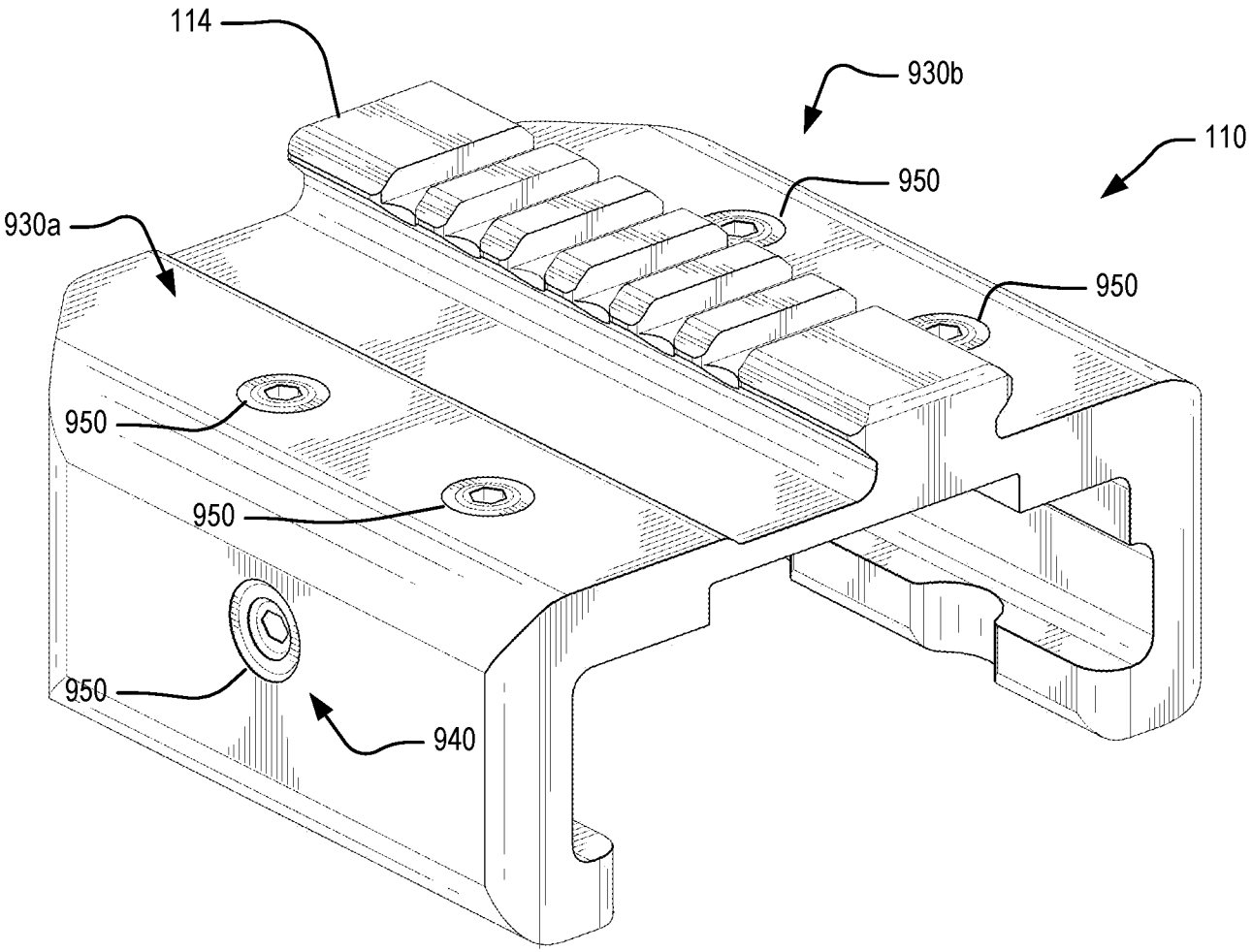
Figure 10A:
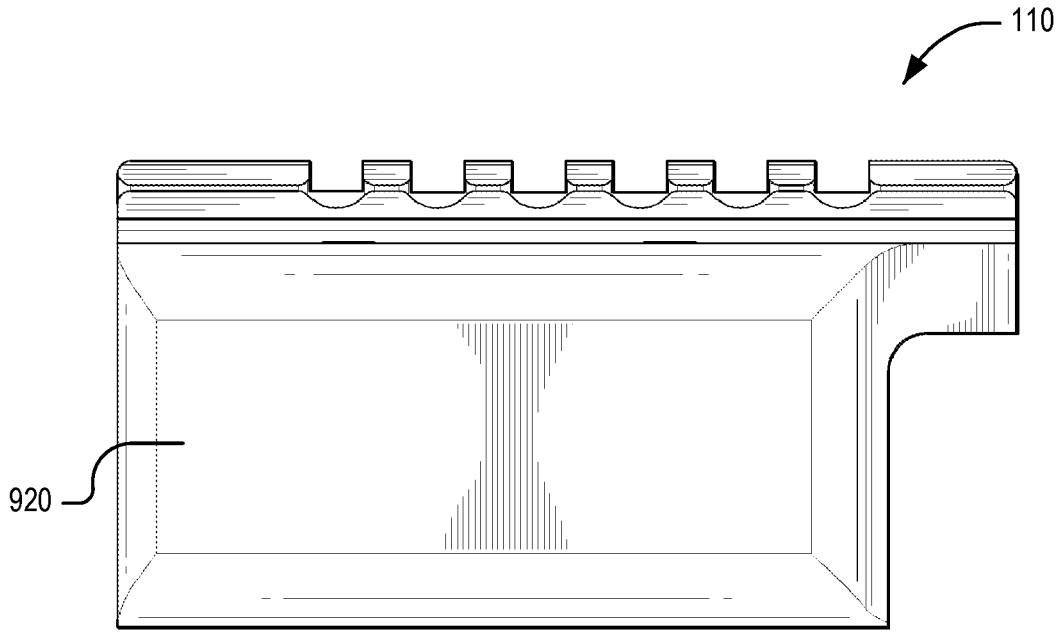
FIGS. 10A-10B are left and right side plan views, respectively, of the base of the accessory mounting system, in accordance with embodiments of the present invention.
Figure 10B:
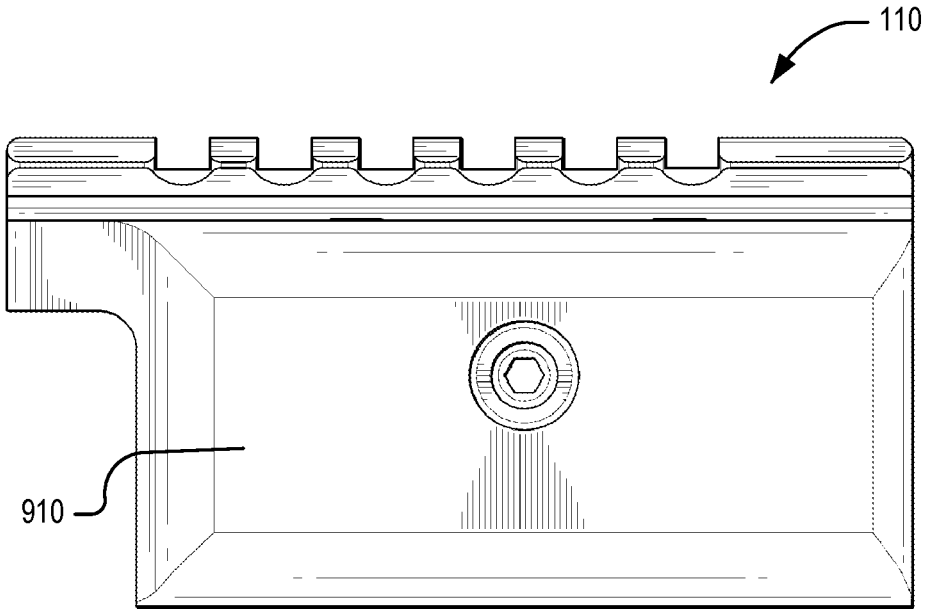
Figure 11A:
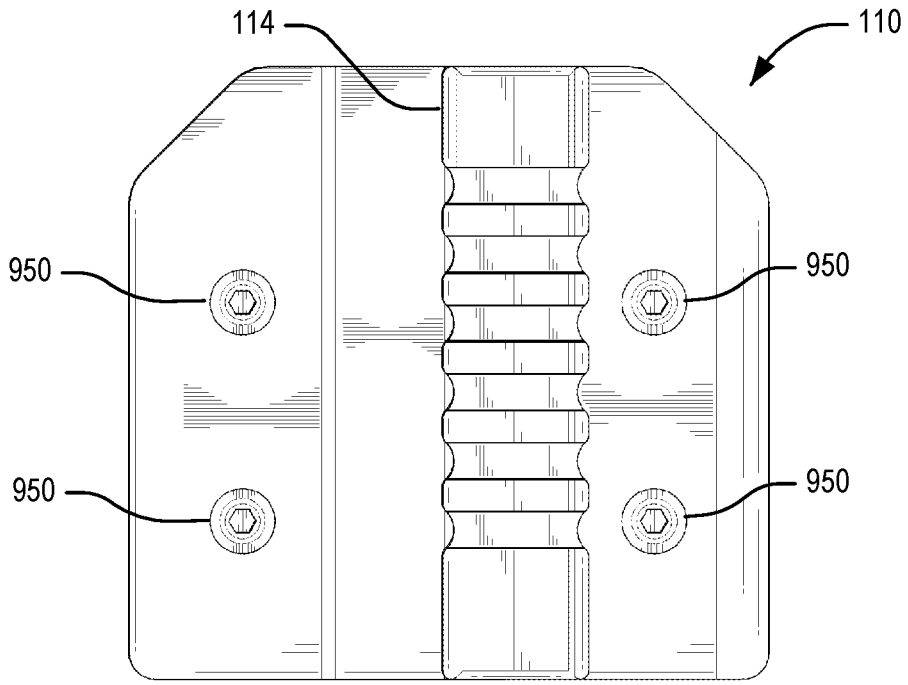
FIGS. 11A-11B are top and bottom plan views, respectively, of the base of the accessory mounting system, in accordance with embodiments of the present invention.
Figure 11B:
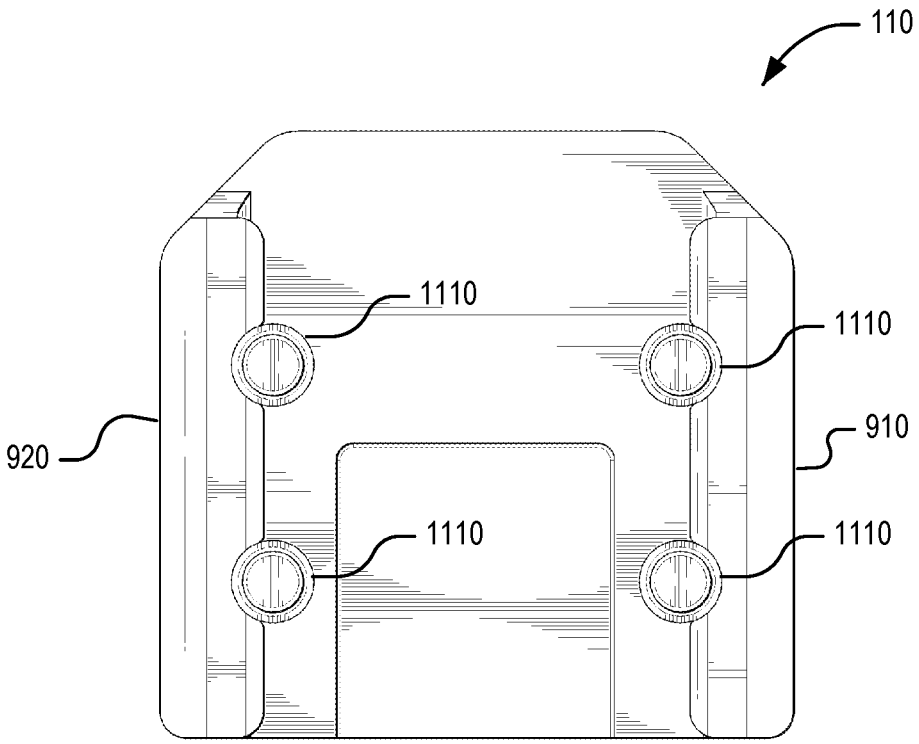
Figure 12A:
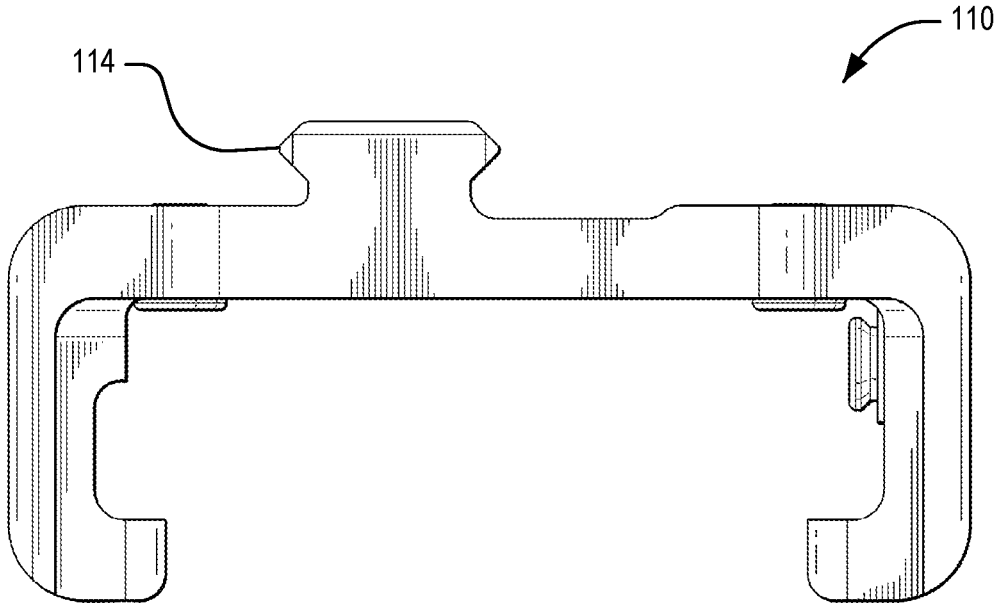
FIGS. 12A-12B are front and rear plan views, respectively, of the base of the accessory mounting system, in accordance with embodiments of the present invention.
Figure 12B:
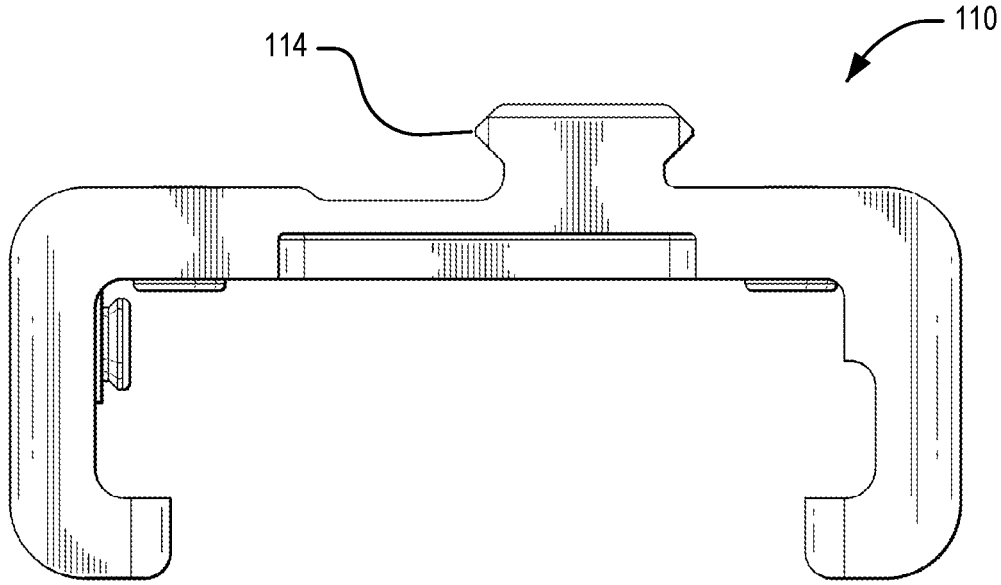

FIGS. 9A-9B are front and rear perspective views of the base 110 of the accessory mounting system 100, in accordance with embodiments of the present invention. FIGS. 10A-10B are left and right side plan views, respectively, of the base 110; FIGS. 11A-11B are top and bottom plan views, respectively, of the base 110; and FIGS. 12A-12B are front and rear plan views, respectively, of the base 110.

Figure 13:
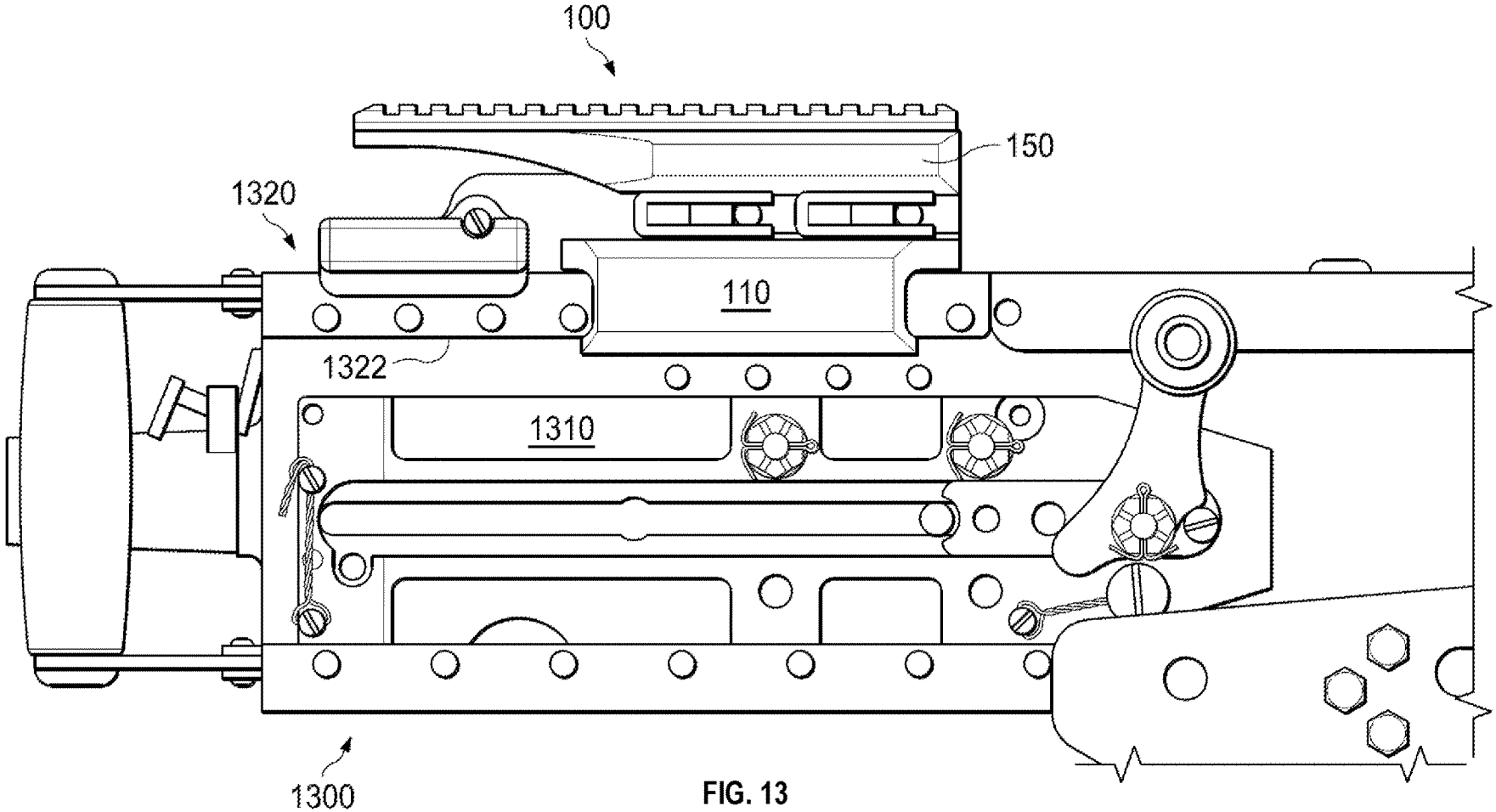
FIG. 13 is a right side view of the accessory mounting system mounted to a firearm, in accordance with embodiments of the present invention.

FIG. 13 is a right side view of the system 100 mounted to the receiver 1310 of a firearm 1300, e.g., an M2 machine gun.

In the illustrated embodiment, the base 110 includes a host connector portion 112 operable to couple with the receiver component of the M2 machine gun and a mount connector portion 114 operable to couple with a corresponding base connector portion 154 of the top mount 150. The top mount 150 includes an accessory mounting rail connector 152 to which an accessory can be attached.

The base assembly 110 comprises a body portion 916, a left side member 910, a right side member 920, and a mount connector 114. An upper end 914 of the left side member 910 and an upper end 924 of the right side member 920 are coupled to the body portion 916. The lower ends of the side members 910, 920 comprise flange members 912, 922, respectively. In the illustrated embodiment, the body portion 916, left side member 910, right side member 920, and mount connector 114 are formed by a single metal component. Any suitable material may be used for the system 100, such as, e.g., aluminum, steel, titanium, or alloys thereof. As can be seen in FIG. 13, the receiver 1310 of the firearm 1300 includes an upper cover 1320 having side portions 1322 which extend laterally beyond the sides of the main body portion of the receiver 1310. In order to mount the base assembly 110 to the firearm 1300, the base assembly 110 can be slid backwards along the top of the receiver 1310 so as to cause the flange members 912, 922 engage these side portions 1322, thereby attaching the base assembly 110 to the firearm 1300.

In order to provide a more secure coupling of the base assembly 110 to the firearm 1300, clamping assemblies may be used in order to take up any slack in the coupling between the base assembly 110 and the receiver 1310. As shown in FIGS. 9A-9B, in the illustrated embodiment, the clamping assemblies comprise two vertical set screw assemblies 930*a*-930*b*, and a lateral set screw assembly 940. The vertical set screw assemblies 930*a*-930*b* each comprise one or more vertically-oriented set screws 950 which can be tightened so as to apply a downward force on the upper side of the receiver 1310, thereby providing a more secure coupling between the flange members 912, 922 and the upper cover 1320.

In some embodiments, it may be desirable to distribute the downward force applied by the set screws 950 onto the top of the receiver 1310 over a larger area than just the lower ends of the set screws 950, so as to prevent the ends of the set screws 950 from digging into the top of the receiver 1310, thereby marring the firearm 1300. One or more force-distributing top plates 1110 (labelled in FIG. 11B) can be coupled to the lower ends of the set screws 950 so as to be positioned between the set screws 950 and the top surface of the receiver 1310 in order to distribute the load applied by the set screws 950 over a larger surface area. In some embodiments, these force-distributing top plates may be made of a material that is softer than the material of the receiver 1310, e.g., brass plates used with a steel receiver. This can further serve to prevent or minimize marring of the receiver 1310. The force-distributing top plates may be made of any suitable material and design. For example, in one embodiment, a round brass plate is coupled to the end of each set screw, e.g., by swaging the plate to the end of the corresponding set screw. In other embodiments, a force-distributing plate is coupled to a plurality of set screws, so as to provide a larger surface area over which the forces from the set screws as distributed.

Similarly, the lateral set screw assembly 940 may comprise one or more laterally-oriented set screws 950 which can be tightened so as to apply a lateral force on a lateral side of the receiver 1310. In the illustrated embodiment, the lateral set screw assembly 940 is provided on the left side member 910 so that the set screws 950 apply a force on the left side of the receiver 1310, thereby providing a more secure coupling between the right side member 920 and the right side of the receiver 1310. One or more force-distributing side plates may also be used, as described above.

The set screws 950 may be configured to receive a hex key for tightening and loosening. In some use cases, the base assembly 110 will frequently be left coupled to the firearm 1300 for extended periods of time (e.g., several days or more), and the top mount 150 with an accessory still attached is removed much more frequently (e.g., every day) in order to separate the accessory from the firearm. The use in some embodiments of hex key set screws 950 may cause the user to spend a greater length of time for attaching and detaching the base assembly 110 from the firearm 1300 than embodiments utilizing clamps or other tool-free mechanisms. However, the burden imposed may be offset by the less frequent need to detach the base assembly 110 from the firearm 1300.

In other embodiments, other types of clamping assemblies may be used to securely and releasably couple the base to the firearm. For example, different numbers, sizes, and configurations of set screw assemblies, set screws, and force-distributing plates may be used in place of the illustrated design.

Some conventional accessory rail systems are attached to the firearm using clamps. Because these clamps provide a fixed amount of travel between the unclamped and fully clamped positions, they may not effectively accommodate variations in the sizes of the various components. For example, in some cases, either the rail system or the receiver may become deformed over time, which can reduce the force applied by the clamps and possibly result in movement of the rail system during use. In other cases, different receivers may have slightly different widths, which can cause the clamps to apply either a greater or lesser clamping force than intended. In accordance with embodiments of the present invention, because the clamping assemblies utilize set screws 950 which can be tightened to a desired torque level, the clamping forces applied by the set screws 950 can be precisely controlled, despite variations in the dimensions of the base 110 and/or the receiver 1310.

In the illustrated embodiment, the mount connector portion 114 of the base assembly 110 comprises a Picatinny rail, also known as a MIL-STD-1913 rail, which extends longitudinally along the top side of the base assembly 110, parallel with the direction of aim of the firearm. The base connector portion 154 of the top mount 150 may utilize any of a variety of designs for coupling the top mount 150 to the mount connector portion 114. In the illustrated embodiment, the base connector portion 154 comprises a fixed lower flange 510 and a side clamping mechanism 520. The side clamping mechanism 520 comprises a pair of levers 522 and a movable side clamp flange 524. When the levers 522 are closed, the side clamp flange 524 applies a lateral force onto the side of the rail (mount connector portion 114) to securely retain the rail between the side clamp flange 524 and the lower flange 510. Advantageously, these levers 522 provide a secure coupling, but can also be quickly and easily released manually without the use of tools.

In the illustrated embodiment, a body portion 916 of the top mount, the lower flange 510, and the accessory mounting rail connector 152 are formed by a single metal component, with the side clamp flange 524 coupled to the body portion 916 using screws 526 which extend from the lower flange 510 side of the top mount 150 to the side clamp flange 524. In other embodiments, the design and components for attaching the side clamp flange can vary.

In some embodiments, the top mount 150 may include one or more additional accessory mounting rail connectors 152. As shown in FIG. 5A, the top mount 150 includes a modular accessory attachment region 540 on the side of the body portion 530 to which an additional accessory mounting rail connector (not shown) may be attached. This additional rail would be oriented such that the position of the rail is rotated 90° relative to the accessory mounting rail connector 152. In the illustrated embodiment, the modular accessory attachment region 540 comprises a recess with two openings for coupling with fasteners on the additional accessory mounting rail connector. An additional accessory can then be mounted to the accessory mounting rail connector. In other embodiments, the modular accessory attachment region can be omitted entirely or multiple the modular accessory attachment regions can be provided, depending on the desired accessory compatibility.

Offset Mount Connector

Many firearms, such as crew-served machine guns, are mounted onto vehicles and equipped with gun shields for protecting the operator of the firearm. These gun shields typically comprise a metal plate with an opening through which the barrel group of the firearm extends. During operation, it is desirable to enable the operator to keep his or her head as low as possible in order to maximize the amount of coverage provided by the gun shield. However, when a conventional accessory mount is attached to the top of the firearm, the optics accessory attached to the accessory mount is positioned far above the top of the firearm, thereby requiring the operator to extend his or her head farther above the top of the firearm in order to use the optics.

In accordance with embodiments of the present invention, the accessory mounting system 100 utilizes a low-profile design so as to position the accessory closer to the firearm than conventional mounts. A low-profile design can be achieved using an offset lateral centerline of the mount connector portion 114. The front plan view of FIG. 4A illustrates the locations of the lateral centerlines for various components of the system. The lateral centerline 440 of the base assembly 110 extends through the point approximately midway between the interior surfaces of the left side member 910 and the right side member 920. When the base assembly 110 is mounted on the receiver 1310, the centerline 440 of the base assembly 110 aligns with the lateral centerline 410 of the receiver 1310. In addition, the centerline 430 of the accessory mounting rail connector 152 aligns with the centerline 440 of the base assembly 110, and, therefore, also aligns with the lateral centerline 410 of the receiver 1310. This may be desirable so that the optics or other accessory mounted to the accessory mounting rail connector 152 is also laterally aligned with the centerline 410 of the receiver 1310.

In accordance with embodiments of the present invention, the lateral centerline 420 of the mount connector portion 114 of the base 110 is laterally offset from the centerline 430 of the accessory mounting rail connector 152 and the centerline 410 of the receiver 1310. As a result of this offset, the levers 522 may be positioned closer to the side of the base assembly 110 and directly above the top of the base assembly 110, thereby improving the operator's access to the levers 522. In some embodiments, the bottom side of the levers 522 are positioned less than approximately 3 mm, 2 mm, or 1 mm above the upper surface of the base assembly 110. If the levers 522 were positioned closer to the centerline 440 of the base 110, the body portion 916 of the base 110 would get in the way, thereby making it more difficult for the operator to reach the levers 522 with his or her fingers. To overcome this, the levers 522 may be positioned further away from the top of the base assembly 110, so as to provide easier access to the levers 522 without the body portion 916 getting in the way. However, this could cause an undesirable increase in the overall height of the system 100.

In accordance with embodiments of the present invention, the accessory mounting system 100 provides a low profile such that the distance from the top of the accessory mounting rail connector 152 to the top of the receiver 1310 is less than approximately 2.5", 2.1", or 2.0".

It is noted that the centerlines 410, 430, and 440 may be considered to be aligned even though they are not in precisely the same location, due to the slack provided between the left side member 910 and the right side member 920 which is taken up by the lateral set screw assembly 940, as well as other tolerances and deviations. In some embodiments, the centerlines 410, 440, may be separated by any distance that avoids an undesirable level of lateral error in the zeroing procedures for the mounted optics and still be considered as being aligned. In one example, an acceptable level of offset of the centerlines is up to 5 mm. When used with an M2 firearm, a 5 mm offset of the centerlines would produce a 50 cm lateral error at 1000 m, which could be an acceptable level of variation. Accordingly, up to a 5 mm offset of the centerlines would still be considered as being aligned. In other embodiments, an offset of up to approximately 1 mm would be considered as being aligned.

Sight Access Features

Many firearms, such as the M2, are provided by default with an iron sight system. As described herein, embodiments of the present invention can provide users with the option of utilizing more modern and useful sighting systems in place of or to supplement these standard iron sights. Conventional iron sight systems can comprise two component sights: a rear sight mounted on the top of the receiver and a front sight provided on the top of the barrel or barrel group. Any structure that is attached to the top of the receiver 1310 of a firearm 1300 could potentially interfere with the operator's use of the iron sight system.

In accordance with embodiments of the present invention, a firearm accessory mounting system is provided which can be attached to the top of a receiver of a firearm while still enabling use of and/or access to the iron sight system.

In some embodiments, the top mount 150 includes a sight passage opening 155, which extends the length of the top mount 150 such that a line of sight from the rear sight to the front sight passes through the sight passage opening 155, thereby enabling an operator to utilize the iron sight system in addition to the use of an accessory attached to the top mount 150. In some embodiments, the bottom 156 of the sight passage opening 155 is positioned approximately 23 mm above the top of the receiver 1310, which leaves the 8.5 mm rear ring of the M2 iron sight substantially unobstructed.

In some embodiments, the top mount 150 may include a sight access cutout 200 (as can be seen in FIGS. 1 and 2A-2B). In many firearms, e.g., the iron sight system includes a knob or other adjustment mechanism that the operator must access from the lateral side of the firearm (not shown in FIG. 13). In embodiments in which the rail connector 152 extends rearward on the firearm 1300 such that it overlays the iron sight adjustment mechanism, the sight access cutout 200 provides a thinner side profile for the top mount 150 than the portion of the top mount 150 coupled to the base 110, as can be seen in FIGS. 2A-2B. This cutout 200 is positioned so as to provide the operator with unobstructed access to the adjustment mechanism on the side of the iron sight system. In one example, the iron sight adjustment knob for an M2 firearm is 15.6 mm in diameter and is located approximately 60 mm from the rear of the receiver 1310 (not including the spade grip assembly) and approximately 17 mm from the top of the receiver 1310. The cutout 200 positioned to provide unobstructed access to the adjustment knob.

While the invention has been described in terms of particular embodiments and illustrative figures, those of ordinary skill in the art will recognize that the invention is not limited to the embodiments or figures described. For example, in various embodiments described above, the firearm accessory mounting system is sized and configured for use with an M2 machine gun. Many of the aspects described herein are particularly desirable when used with belt-fed, crew-serviced M2 machine gun, which is a very heavy firearm with a large receiver system. For instance, example mounting systems described above can provide a low profile for an optics mount, while still having a pass-through to utilize the standard M2 iron sights. In addition, the ability to quickly detach the top mount from the base, and then re-index the accessory to the same location upon re-mounting can improve the ease and speed with which soldiers can comply with accountability requirements for sensitive items, such as optics and other accessories. In other embodiments, the system may be sized and configured for use with other types of weapons, including, e.g., other types of belt-fed and/or crew-serviced firearms.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show details of the invention in more detail than is necessary for the fundamental understanding of the invention, the description taken with the drawings and/or examples making apparent to those skilled in the art how the several forms of the invention may be embodied in practice.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural and singular number, respectively. Additionally, the words "herein," "above," and "below" and words of similar import, when used in this application, shall refer to this application as a whole and not to any particular portions of the application.

The description of embodiments of the disclosure is not intended to be exhaustive or to limit the disclosure to the precise form disclosed. While specific embodiments and examples for the disclosure are described herein for illustrative purposes, various equivalent modifications are possible within the scope of the disclosure, as those skilled in the relevant art will recognize. Such modifications may include, but are not limited to, changes in the dimensions and/or the materials shown in the disclosed embodiments.

Specific elements of any embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the disclosure.

Therefore, it should be understood that the invention can be practiced with modification and alteration within the spirit and scope of the appended claims. The description is not intended to be exhaustive or to limit the invention to the precise form disclosed. It should be understood that the invention can be practiced with modification and alteration and that the invention be limited only by the claims and the equivalents thereof.

What is claimed is:

1. A firearm accessory mounting system, comprising:

a base assembly comprising:

a host connector on a bottom side of the base assembly operable to couple with a firearm; and a mount connector on a top side of the base assembly, the mount connector comprising a first rail connector; and a top mount comprising:

a base connector on a bottom side of the top mount, the base connector being detachably coupled to the first rail connector of the mount connector of the base assembly, the base connector comprising:

a first side member integrally formed with a body of the top mount, the first side member comprising a first flange engaging a first side of the first rail connector;

a second side member comprising a second flange engaging a second side of the first rail connector; and a clamping assembly applying a releasable lateral force on the second side member to releasably couple the base connector to the first rail connector, wherein the clamping assembly comprises a movable side clamp flange and at least one lever configured to apply a lateral force onto the movable side clamp flange; and a second rail connector on a top side of the top mount; wherein:

a lateral centerline of the first rail connector is laterally offset from a lateral centerline of the base assembly; and the second rail connector of the top mount extends longitudinally on the top side of the top mount such that the second rail connector of the top mount vertically overlaps the centerline of the base assembly.

2. The firearm accessory mounting system of claim 1, wherein the host connector of the base assembly comprises:

a first side member comprising an upper end and an opposing lower end, wherein the upper end of the first side member is coupled to a body portion of the base assembly and the lower end of the first side member comprises a first flange member; and a second side member comprising an upper end and an opposing lower end, wherein the upper end of the second side member is coupled to the body portion of the base assembly and the lower end of the second side member comprises a second flange member.

3. The firearm accessory mounting system of claim 2, wherein the host connector of the base assembly further comprises:

a vertical set screw assembly comprising a plurality of vertically-oriented set screws and at least one force distributing top plate coupled to a distal end of at least one of the plurality of vertically-oriented set screws; and a lateral set screw assembly comprising a plurality of laterally-oriented set screws extending through the first side member and at least one force distributing side plate coupled to a distal end of at least one of the plurality of laterally-oriented set screws.

4. The firearm accessory mounting system of claim 2, wherein a vertical distance from a bottom surface of the body portion of the base assembly to an upper surface of the second rail connector of the top mount is less than approximately 2.5 inches.

5. The firearm accessory mounting system of claim 1, further comprising:

a firearm having a receiver portion, wherein the host connector of the base assembly is detachably coupled to the receiver portion.

6. The firearm accessory mounting system of claim 5, wherein the firearm comprises a belt-fed crew-serviced machine gun.

7. The firearm accessory mounting system of claim 5, wherein the firearm comprises an M2 machine gun.

8. The firearm accessory mounting system of claim 5, wherein:

the firearm further comprises:

a rear sight coupled to the receiver portion; and a front sight coupled to a barrel group of the firearm; and the top mount further comprises a sight passage opening extending a length of the top mount, wherein a line of sight from the rear sight to the front sight passes through the sight passage opening.

9. The firearm accessory mounting system of claim 1, wherein the top mount further comprises:

a third rail connector on a lateral side of the top mount.

10. An accessory system, comprising:

a base assembly comprising:

a body portion;

a host connector on a bottom side of the base assembly comprising:

a first side member having a first upper end coupled to a first side of the body portion and a first lower end comprising a first flange; and a second side member having a second upper end coupled to a second side of the body portion and a second lower end comprising a second flange; and a first rail connector on a top side of the base assembly, the first rail connector comprising a narrow lower portion and a flanged upper portion; and a top mount comprising:

a base connector on a bottom side of the top mount, the base connector comprising a lower flange and an adjustable side clamp detachably coupled to the first rail connector of the base assembly; and a second rail connector on a top side of the top mount; wherein:

a centerline of the first rail connector is laterally offset from a centerline of the base assembly; and the second rail connector extends longitudinally on the top side of the top mount such that a centerline of the second rail connector is aligned with the centerline of the base assembly.

11. The accessory system of claim 10, wherein:

the body portion of the base assembly comprises at least one set screw configured to apply a downward force on a receiver component positioned between the first side member and the second side member.

12. The accessory system of claim 10, wherein:

the body portion of the base assembly comprises at least one lateral set screw extending through the first side member and configured to apply a lateral force on a receiver component positioned between the first side member and the second side member.

13. The accessory system of claim 10, wherein:

the adjustable side clamp detachably comprises a movable side clamp flange and at least one lever configured to apply a lateral force onto the movable side clamp flange towards the lower flange when tightened.

14. The accessory system of claim 10, further comprising:

a firearm having a receiver portion received between the first side member and the second side member of the host connector.

15. The accessory system of claim 10, wherein:

a vertical distance from a bottom surface of the body portion of the base assembly to an upper surface of the second rail connector of the top mount is less than 2.5 inches.

16. The firearm accessory mounting system of claim 5, wherein:

the host connector of the base assembly is detachably connected to the receiver portion of the firearm without use of a rail.

17. The accessory system of claim 14, wherein:

the firearm further comprises:

a rear sight coupled to the receiver portion; and a front sight coupled to a barrel group of the firearm; and the top mount further comprises a sight passage opening extending a length of the top mount, wherein a line of sight from the rear sight to the front sight passes through the sight passage opening.

* * * * *